US009620270B2

(12) United States Patent
Uemoto et al.

(10) Patent No.: US 9,620,270 B2
(45) Date of Patent: Apr. 11, 2017

(54) COMPOSITE MAGNETIC CORE AND MAGNETIC ELEMENT

(71) Applicant: NTN CORPORATION, Osaka (JP)

(72) Inventors: Ikuo Uemoto, Mie (JP); Shinji Miyazaki, Mie (JP); Takuji Harano, Mie (JP)

(73) Assignee: NTN CORPORATION, Osaka (JP)

( * ) Notice: Subject to any disclaimer, the term of this patent is extended or adjusted under 35 U.S.C. 154(b) by 0 days.

(21) Appl. No.: 14/417,095

(22) PCT Filed: Jul. 24, 2013

(86) PCT No.: PCT/JP2013/069998
§ 371 (c)(1),
(2) Date: Jan. 23, 2015

(87) PCT Pub. No.: WO2014/017512
PCT Pub. Date: Jan. 30, 2014

(65) Prior Publication Data

US 2015/0179323 A1 Jun. 25, 2015

(30) Foreign Application Priority Data

Jul. 25, 2012 (JP) ..... 2012-164748

(51) Int. Cl.
*H01F 27/24* (2006.01)
*H01F 7/06* (2006.01)
(Continued)

(52) U.S. Cl.
CPC ..... *H01F 3/08* (2013.01); *H01F 3/10* (2013.01); *H01F 17/04* (2013.01);
(Continued)

(58) Field of Classification Search
CPC ..... H01F 3/08; H01F 3/10; H01F 3/14; H01F 17/04; H01F 27/255; H01F 2003/106; H01F 41/0246; H01F 41/005
(Continued)

(56) References Cited

U.S. PATENT DOCUMENTS

2008/0078474 A1* 4/2008 Naito ..... C22C 33/0207 148/304
2010/0253455 A1* 10/2010 Wolf ..... H01F 38/12 336/83

FOREIGN PATENT DOCUMENTS

CN 101010756 A 8/2007
JP 54-050922 A 4/1979
(Continued)

OTHER PUBLICATIONS

Supplementary European Search Report in Corresponding Application dated Feb. 1, 2016.
(Continued)

*Primary Examiner* — Mangtin Lian
(74) *Attorney, Agent, or Firm* — Hedman & Costigan, P.C.; James V. Costigan; Kathleen A. Costigan

(57) ABSTRACT

The present invention provides a composite magnetic core, containing magnetic powders poor in its moldability, which can be configured arbitrarily and has a magnetic characteristic excellent in direct current superimposition characteristics and a magnetic element composed of the composite magnetic core and a coil wound around the circumference thereof. A compressed magnetic body (2) obtained by compression-molding magnetic powders is combined with an injection-molded magnetic body (3) obtained by mixing a binding resin with magnetic powders having surfaces thereof electrically insulated and by injection-molding a mixture of the magnetic powders and the binding resin. The compressed magnetic body (2) is press-fitted into the injec-
(Continued)

tion-molded magnetic body (3) or bonded thereto at a combining portion thereof to obtain the combined body. The combined body is composed of the injection-molded magnetic body (3) constituting a housing in which the compressed magnetic body (2) is disposed.

4 Claims, 10 Drawing Sheets

(51) Int. Cl.

| | |
|---|---|
| ***H01F 3/08*** | (2006.01) |
| ***H01F 27/255*** | (2006.01) |
| ***H01F 3/10*** | (2006.01) |
| ***H01F 17/04*** | (2006.01) |
| ***H01F 41/00*** | (2006.01) |
| ***H01F 41/02*** | (2006.01) |

(52) U.S. Cl.
CPC ..... *H01F 27/255* (2013.01); *H01F 41/005* (2013.01); *H01F 41/0246* (2013.01); *H01F 2003/106* (2013.01)

(58) Field of Classification Search
USPC ..... 336/212, 233, 221, 214, 215; 29/602.1
See application file for complete search history.

(56) References Cited

FOREIGN PATENT DOCUMENTS

| | | | |
|---|---|---|---|
| JP | 61-120858 | A | 6/1986 |
| JP | 05-055061 | A | 3/1993 |
| JP | 06-013243 | A | 1/1994 |
| JP | 2001-332411 | A | 11/2001 |
| JP | 2002-057039 | A | 2/2002 |
| JP | 2004-207552 | A | 7/2004 |
| JP | 2005-093962 | A | 4/2005 |
| JP | 2006-332245 | A | 12/2006 |
| JP | 2007-227426 | A | 9/2007 |
| JP | 2007-291454 | A | 11/2007 |
| JP | 2010-118521 | A | 5/2010 |
| JP | 4763609 | B2 | 8/2011 |
| JP | 2011-205052 | A | 10/2011 |
| JP | 2013-026419 | A | 2/2013 |
| KR | 10-2007-0050926 | A | 5/2007 |
| KR | 10-1204873 | B1 | 11/2012 |
| WO | 2006/022262 | A1 | 3/2006 |

OTHER PUBLICATIONS

English Abstract for JP 54-050922 dated Apr. 21, 1979.
International Search Report in corresponding application dated Nov. 12, 2013.

* cited by examiner

COMPOSITE MAGNETIC CORE AND MAGNETIC ELEMENT

TECHNICAL FIELD

The present invention relates to a composite magnetic core and a magnetic element consisting of the composite magnetic core and a coil wound around the circumference thereof.

BACKGROUND ART

In recent years, in the prevailing trend toward a decrease in the size of electrical and electronic equipment, the flow of electric current having higher frequencies through circuits thereof, and the application of higher electric current thereto, not only the electrical and electronic equipment but also components of the magnetic core are required to follow the trend in the production thereof. But the characteristic of a ferrite material which presently prevails reaches the limit. Consequently new materials for the magnetic core are being searched for. For example, the ferrite material is being replaced with compressed magnetic materials such as sendusts, amorphous materials, and an amorphous foil band. But the compressed magnetic materials have a poor moldability and a low mechanical strength after they are fired. The production cost of the amorphous foil band is high because it is produced through a winding process, a cutting process, and a gap forming process. For this reason, practical applications of these magnetic materials have been delayed.

To produce components of the magnetic core which have a configuration variation and characteristics, are compact, and are inexpensive by using magnetic powders having a low moldability, the present applicant proposed a method including the step of coating the magnetic powders contained in the resin composition to be injection-molded with an insulation material and the step of forming the compressed powder magnetic body or the compressed powder magnet in the resin composition by insert molding, and the step of obtaining the components of the magnetic core having a predetermined magnetic characteristic by injection molding. The compressed powder magnetic body or the compressed powder magnet contains a binding agent having a melting point lower than an injection molding temperature. The present applicant obtained a patent for the invention (patent document 1).

An electromagnetic equipment, for a noise filter, which has a composite magnetic core using an amorphous magnetic thin belt as its magnetic core is known. Description is made in the patent specification that the electromagnetic equipment for the noise filter is capable of securing insulation between the winding and the magnetic core and preventing the amorphous magnetic thin band from being cracked and chipped by an external force and the magnetic characteristic thereof from changing. The composite magnetic core of the electromagnetic equipment is constructed of the flanged tubular ferrite magnetic core having the flange at both ends thereof and of the amorphous magnetic thin belt wound around the tubular portion of the ferrite magnetic core within the range not exceeding the height of the flanges. The toroidal coil is wound around the composite magnetic core (patent document 2).

As a composite core material which restrains the level of heat generated owing to an eddy current from increasing from the level of the heat generated by a magnetic core consisting of a compressed powder compact, achieves a high magnetic permeability, has a high strength, and is applicable to use where a vibration and a stress are applied, the proposed composite magnetic material consists of the laminate of the layer of the compressed powder compact formed by coating the surfaces of the powder particles of the magnetic material with the insulating substance and by compression-molding the powders with the powders being electrically insulated and the layer of the rolled magnetic material different from the above-described one (patent document 3).

PRIOR ART DOCUMENTS

Patent Documents

Patent document 1: U.S. Pat. No. 4,763,609
Patent document 2: Japanese Unexamined Patent Application Laid-Open Publication No. 5-55061
Patent document 3: Japanese Unexamined Patent Application Laid-Open Publication No. 2001-332411

SUMMARY OF THE INVENTION

Problem to be Solved by the Invention

The composite magnetic core component of the patent document 1 produced by the insert molding has the following problems in the production thereof: (1) Molding cycle time is long. (2) It is necessary to control the temperature of a workpiece (compression). (3) It is necessary to use an automatic machine for forming the workpiece by the insert molding.

The composite magnetic core of the electromagnetic equipment for the noise filter described in the patent document 2 has a problem that it is difficult to form the flanged tubular ferrite magnetic core having the flange at both ends thereof by powder compression molding. In the composite magnetic core, the amorphous magnetic thin band is wound around the ferrite magnetic core. The coil wound around the composite magnetic core is wound as a toroidal coil not by bringing the coil into contact with the amorphous magnetic thin belt, but by bringing the coil into contact with the ferrite magnetic core. Thus the configuration of the composite magnetic core is limited to a specific configuration such as a donut configuration so that toroidal winding around the ferrite magnetic core can be achieved. In the case where an attempt is made to wind the coil around the outer circumference of the magnetic core as a rod-shaped coil, the coil directly contacts the amorphous magnetic thin band. Consequently the composite magnetic core has a problem that the amorphous magnetic thin band is liable to crack. Thus it is difficult to wind the coil and in addition the magnetic characteristic thereof deteriorates owing to a stress applied thereto at a coil-winding time.

In the composite magnetic material of the patent document 3 having the two layers laminated one upon another, the outer layer consists of the layer of the compressed powder compact such as sendust, and the inner layer consists of the metallic rolled material. Therefore the composite magnetic material has a problem that it is difficult to mold both magnetic materials into molded bodies having a complicated configuration respectively and laminate both molded bodies one upon another.

The present invention has been made to deal with the above-described problems. Therefore it is an object of the present invention to provide a composite magnetic core, containing magnetic powders poor in its moldability, which can be configured arbitrarily and has magnetic characteristics excellent in direct current superimposition characteristics and a magnetic element composed of the composite magnetic core and a coil wound around the circumference thereof.

Means for Solving the Problem

The composite magnetic core of the present invention is composed of a combined body of a compressed magnetic body, obtained by compression-molding magnetic powders, which is combined with an injection-molded magnetic body obtained by mixing a binding resin with magnetic powders having surfaces thereof electrically insulated and by injection-molding a mixture of the magnetic powders and the binding resin, wherein the injection-molded magnetic body constitutes a housing and the compressed magnetic body is disposed inside the housing.

The compressed magnetic body is obtained by compression-molding the magnetic powders to form a compressed powder compact and by firing the formed compressed powder compact. The magnetic powders are ferrite powders. The magnetic powders of the injection-molded magnetic body constituting the housing are amorphous metal powders, and the binding resin is thermoplastic resin.

The combined body composed of the compressed magnetic body combined with the injection-molded magnetic body constituting the housing is formed by press-fitting the compressed magnetic body into the housing or bonding the compressed magnetic body thereto. The compressed magnetic body is disposed inside a space of the housing with the compressed magnetic body in close contact with the injection-molded magnetic body or with a gap being kept inside the space of the housing.

The composite magnetic core of the present invention is characterized in that when a value of superimposed direct current flowing through a coil wound around a circumference of the combined body is increased, a decrease rate of an inductance of the composite magnetic core is lower than that of an inductance of a ferrite magnetic core.

The magnetic element of the present invention includes the composite magnetic core of the present invention and a coil wound around a circumference of the composite magnetic core. The magnetic element is incorporated in circuits of electronic devices. The composite magnetic core is formed by press-fitting the compressed magnetic body into the housing or bonding the compressed magnetic body thereto.

Effect of the Invention

In the present invention, the composite magnetic core has the injection-molded magnetic body constituting the housing and the compressed magnetic body, consisting of the magnetic material such as the ferrite powders, which is disposed inside the housing. Thus it is possible to dispose the compressed magnetic body at a portion where the magnetic flux density is desired to be high. Therefore the magnetic flux density of the composite magnetic core is allowed to be higher than that of the magnetic core consisting of the injection-molded magnetic body. Consequently the magnetic core is allowed to be compact.

Because the configuration of the compressed magnetic body can be simplified, the magnetic powders can be easily compression-molded and thus the filling density of the composite magnetic core can be enhanced. Consequently even though the compressed magnetic body consists of the magnetic powders poor in its moldability, by combining the compressed magnetic body with the injection-molded magnetic body, the formed composite magnetic core is allowed to have a desired configuration and an excellent magnetic characteristic and be compact and inexpensive.

In combining the compressed magnetic body and the injection-molded magnetic body with each other to form the composite magnetic core, the compressed magnetic body is press-fitted into the injection-molded magnetic body constituting the housing or bonded thereto. Therefore as compared with composite magnetic cores produced by insert molding, it is possible to allow the cost of equipment for producing the composite magnetic core of the present invention to be lower, the productivity of the equipment to be higher, the production cost of the composite magnetic core to be lower, and the degree of freedom in designing the configuration thereof to be higher.

MODE FOR CARRYING OUT THE INVENTION

Figure 1:
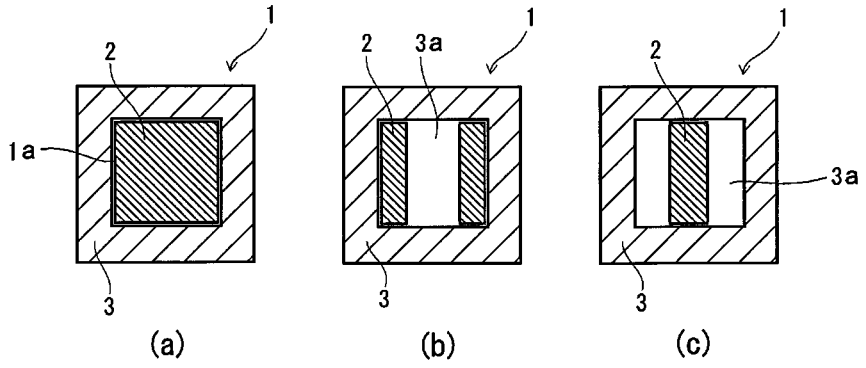
FIG. 1 shows a state in which a compressed magnetic body and an injection-molded magnetic body are combined with each other.

In the prevailing trend toward a decrease in the size of electrical and electronic equipments, the flow of electric current having higher frequencies through circuits thereof, a ferrite material obtained by a compression molding method which currently prevails in molding methods is superior in its magnetic flux density (magnetic permeability) and inductance value, but inferior in its frequency characteristic and current superimposition characteristic. On the other hand, an injection moldable magnetic material consisting of an amorphous material is superior in its frequency characteristic and current superimposition characteristic, but inferior in its magnetic flux density (magnetic permeability) and inductance value.

It is possible to form the injection moldable magnetic material for a magnetic core by mixing ferrite powders and amorphous powders with each other. But in this case, it is difficult to adjust the balance between the mechanical strength and magnetic characteristic of the magnetic core and injection-mold the injection moldable magnetic material into a magnetic core having a desired configuration. Particularly, in forming a rod-like or prismatic ultra-small magnetic core having a height as short as not more than 5 mm, it is difficult to form the magnetic core by injection molding.

By separately producing an injection-molded magnetic body as a housing by injection-molding the amorphous material and a compressed magnetic body which can be disposed inside the housing by compression-molding a magnetic material and thereafter by combining the injection-molded magnetic body and the compressed magnetic body with each other, it was possible to hold the strength of each material and enhance the degree of freedom in designing the configuration and the like of the magnetic core, allow successive mass production of the magnetic core to be achieved, and adjust the balance among magnetic characteristics of the magnetic materials. The present invention is based on such findings.

It is possible to use the following magnetic materials as the raw materials for the compressed magnetic body which constitutes the composite magnetic core. Examples of the magnetic materials include a pure iron-based soft magnetic material such as iron powder and iron nitride powder; a ferrous alloy-based soft magnetic material such as Fe—Si—Al alloy (sendust) powder, super sendust powder, Ni—Fe alloy (permalloy) powder, Co—Fe alloy powder, and Fe—Si—B-based alloy powder; a ferrite-based magnetic material; an amorphous magnetic material; and a microcrystalline material.

Examples of the ferrite-based magnetic material include spinel ferrite having a spinel crystalline structure such as manganese zinc ferrite, nickel-zinc ferrite, copper zinc ferrite, and magnetite; hexagonal ferrite such as barium ferrite, strontium ferrite; and garnet ferrite such as yttrium iron garnet. Of these ferrite-based magnetic materials, the spinel ferrite which is a soft magnetic ferrite is preferable because it has a high magnetic permeability and a small eddy current loss in a high frequency domain.

Examples of the amorphous magnetic material include iron-based alloys, cobalt-based alloys, nickel-based alloys, and mixtures of these amorphous alloys.

Examples of oxides forming insulation coating on the surfaces of powder particles of the soft magnetic metal to be used as raw materials for the compressed magnetic body include oxides of insulating metals or semimetals such as $Al_2O_3$, $Y_2O_3$, MgO, and $ZrO_2$, glass, and mixtures of these substances.

As methods of forming the insulation coating, it is possible to use a powder coating method such as mechanofusion, a wet thin film forming method such as electroless plating and a sol-gel method, and a dry thin film forming method such as sputtering.

The compressed magnetic body can be produced by compression-molding the above-described material powders having the insulation coating formed on the surfaces of powder particles or compression-molding powders, consisting of the above-described material powders, which have been mixed with thermosetting resin such as epoxy resin to form a compressed powder compact and thereafter firing the compressed powder compact.

The average diameter of the material powder particles is favorably 1 to 150 μm and more favorably 5 to 100 μm. In the case where the average diameter of the material powder particles is less than 1 μm, the compressibility (a measure showing the hardenability of powder) thereof is low at a compression-molding time, and consequently the strength thereof is outstandingly low after they are fired. In the case where the average diameter of the material powder particles is more than 150 μm, the iron loss thereof is high in a high frequency domain and consequently magnetic characteristic (frequency characteristic) thereof is low.

Supposing that the total of the amount of the material powders and that of the thermosetting resin is 100 percentages by mass, it is preferable that the mixing ratio of the material powders is set to 96 to 100 percentages by mass. When the mixing ratio thereof is less than 96 percentages by mass, i.e., when the mixing ratio thereof is low, the magnetic flux density and magnetic permeability thereof are low.

As the powder compression molding method, it is possible to use a method of filling the material powders into a die and press-molding the material powders at a predetermined pressure to form the compressed powder compact. A fired object is obtained by firing the compressed powder compact. In the case where amorphous alloy powders are used as the material for the compressed magnetic body, it is necessary to set a firing temperature lower than a crystallization start temperature of the amorphous alloy. In the case where the powders with which the thermosetting resin has been mixed is used, it is necessary to set the firing temperature to a range in which the resin hardens.

The injection-molded magnetic body which constitutes the housing is obtained by mixing a binding resin with the material powders for the compressed magnetic body and injection-molding the mixture of the binding resin and the material powders.

It is preferable to adopt the amorphous metal powders as the magnetic powder because the amorphous metal powders allow the injection molding to be easily performed, the configuration of the injection-molded magnetic body to be easily maintained, and the composite magnetic core to have an excellent magnetic characteristic.

As the amorphous metal powders, it is possible to use the above-described iron-based alloys, cobalt-based alloys, nickel-based alloys, and mixtures of these amorphous alloys. The insulation coating is formed on the surfaces of these amorphous metal powders.

As the binding resin, it is possible to use thermoplastic resin which can be injection-molded. Examples of the thermoplastic resin include polyolefin such as polyethylene and polypropylene, polyvinyl alcohol, polyethylene oxide, polyphenylene sulfide (PPS), liquid crystal polymer, polyether ether ketone (PEEK), polyimide, polyetherimide, polyacetal, polyether sulfone, polycarbonate, polyethylene terephthalate, polybutylene terephthalate, polyphenylene oxide, polyphthalamide, polyamide, and mixtures of these binding resins. Of these binding resins, the polyphenylene sulfide (PPS) is more favorable than the other thermoplastic resins because the polyphenylene sulfide (PPS) is excellent in its flowability at an injection molding time when it is mixed with the amorphous metal powders, is capable of coating the surface of the injection-molded body, and is excellent in its heat resistance.

Supposing that the total of the amount of the material powders and that of the thermoplastic resin is 100 percentages by mass, it is preferable to set the mixing ratio of the material powders to 80 to 95 percentages by mass. In the case where the mixing ratio of the material powders is less than 80 percentages by mass, the mixture of the binding resin and the material powders is incapable of obtaining the predetermined magnetic characteristic. In the case where the mixing ratio of the material powders is more than 95 percentages by mass, the mixture has inferior injection moldability.

As the injection molding method, it is possible to use a method of injecting the material powders into a die consisting of a movable half thereof combined with a fixed half thereof. As an injection-molding condition, it is preferable to set the temperature of the resin to 290 to 350° C. and the temperature of the die to 100 to 150° C. in the case of the polyphenylene sulfide (PPS), although the injection-molding condition is different according to the kind of the thermoplastic resin.

The compressed magnetic body and the injection-molded magnetic body are separately produced by the above-described method and combined with each other. The former and the latter are so configured as to be assembled easily and suitable for compression molding and injection molding respectively. For example, in the case where the bobbin-shaped composite magnetic core not having a shaft hole is formed, a columnar bobbin core is formed as the compressed magnetic body by compression-molding the material powders. A perforated flat disk-shaped bobbin flange is formed as the injection-molded magnetic body by injection-molding the mixture of the binding resin and the material powders. Thereafter by press-fitting both ends of the columnar compressed magnetic body into a hole formed at the center of each of the two flat disk-shaped injection-molded magnetic bodies, the bobbin-shaped composite magnetic core is obtained. Alternatively the columnar bobbin core is formed as the compressed magnetic body by compression-molding the material powders. Thereafter a bobbin-shaped injection-molded magnetic body having the shaft hole into which the columnar compressed magnetic body can be press-fitted is formed by injection-molding the mixture of the binding resin and the material powders. Thereafter by press-fitting the columnar compressed magnetic body into the shaft hole of the injection-molded magnetic body, the bobbin-shaped composite magnetic core is obtained.

As a preferable combination of the material for the compressed magnetic body and that for the injection-molded magnetic body, it is favorable to use the ferrite as the material for the compressed magnetic body and the amorphous metal powders and the thermoplastic resin as the material for the injection-molded magnetic body. It is more favorable to use Fe—Ni-based ferrite as the ferrite, Fe—Si—Cr-based amorphous alloy as the amorphous metal and the polyphenylene sulfide (PPS) as the thermoplastic resin.

The compressed magnetic body and the injection-molded magnetic body constituting the housing are combined with each other by disposing the former inside the latter. The housing means a part mainly constituting the outer circumferential surface of the composite magnetic core.

FIG. 1 shows a state in which the compressed magnetic body and the injection-molded magnetic body are combined with each other. FIGS. 1(*a*) through 1(*c*) are sectional views showing the state in which the components of the composite magnetic core are combined with each other.

In a composite magnetic core 1 of FIG. 1(*a*), a compressed magnetic body 2 is disposed inside an injection-molded magnetic body 3 constituting the housing. The compressed magnetic body 2 is press-fitted into the injection-molded magnetic body 3 or combined therewith with an adhesive agent at a combining portion 1*a*. In the case where the gap in the combining portion 1*a* between the compressed magnetic body 2 and the injection-molded magnetic body 3 is large, there is a fear that an inductance value is small. Thus to combine the compressed magnetic body 2 with the injection-molded magnetic body 3 by press-fitting the former into the latter is more favorable than by bonding the former to the latter because the press-fitting allows the former to contact the latter more closely than the bonding. In the case where the adhesive agent is used, it is preferable to use a solventless type epoxy adhesive agent which allows the compressed magnetic body 2 and the injection-molded magnetic body 3 to closely contact each other.

In the composite magnetic core 1 of FIG. 1(*b*), two compressed magnetic bodies 2 are disposed inside the injection-molded magnetic body 3 constituting the housing with a gap 3*a* being formed between the two compressed magnetic bodies 2. The two compressed magnetic bodies 2 may be identical to each other or different from each other in the compositions thereof. The sectional configurations of the two compressed magnetic bodies 2 may be varied from each other.

In the composite magnetic core 1 of FIG. 1(*c*), one compressed magnetic body 2 is disposed inside the injection-molded magnetic body 3 constituting the housing with two gaps 3*a* being formed inside the injection-molded magnetic body 3. The size of the gaps 3*a* can be arbitrarily altered.

As described above, the magnetic characteristic of the composite magnetic core of the present invention can be easily altered by changing the kind, density, and size of the magnetic material for the compressed magnetic body. Thus it is possible to improve the degree of freedom in designing the magnetic core. In addition, it is possible to shorten a review period from the time when the composite magnetic core is designed till the production thereof starts and unnecessary to produce a die for each composite magnetic core.

The magnetic characteristics of the composite magnetic core were measured by the following method.

As the compressed magnetic body, a cylindrical ferrite core having an outer diameter of 40 mmϕ and an inner diameter of 27 mmϕ was cut in its height direction to prepare three flat cylinder-shaped ferrite cores having a length of 15 mm, 10 mm, and 6 mm respectively. Injection-molded magnetic bodies so configured as to allow the ferrite cores to be inserted respectively by press fit were formed by injection molding. The injection-molded magnetic bodies were cylindrical and had an outer diameter of 48 mmϕ, and an inner diameter of 40 mmϕ, and a height of 20 mm. As the composition of a magnetic body to be injection-molded, 100 parts by mass of amorphous metal powders (amorphous Fe—Si—Cr) having an insulation film formed on the surface thereof and 14 parts by mass of polyphenylene sulfide were mixed with each other to form a pellet to be injection-molded.

The ferrite cores were inserted into the injection-molded magnetic bodies respectively by press fit to form the following three kinds of composite magnetic cores. A ferrite core (shown as ferrite in FIGS. 2 and 3) and an amorphous metal core (shown as AS-10 in FIGS. 2 and 3) were prepared as comparative specimens.

(1) Composite magnetic core 15: The compressed magnetic body consisting of the ferrite core having the height of 15 mm was press-fitted into the injection-molded magnetic body consisting of the amorphous metal.

(2) Composite magnetic core 10: The compressed magnetic body consisting of the ferrite core having the height of 10 mm was press-fitted into the injection-molded magnetic body consisting of the amorphous metal.

(3) Composite magnetic core 6: The compressed magnetic body consisting of the ferrite core having the height of 6 mm was press-fitted into the injection-molded magnetic body consisting of the amorphous metal.

Each of the above-described composite magnetic cores was wound with 20 turns of a copper enamel wire having a diameter of 0.85 mmϕ to form inductors. The magnetic characteristic of each inductor was measured. The inductance value thereof was measured at a measuring frequency of 1 MHz when superimposed direct current flowed through the coil. The results are shown in FIGS. 2 and 3.

Figure 2:
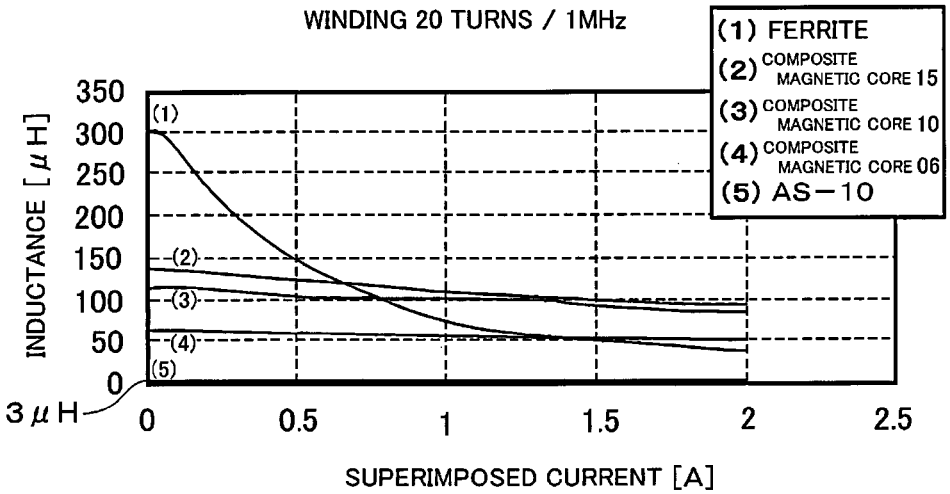
FIG. 2 shows the result of an inductance value measured when superimposed direct current flows through a coil.

As shown in FIG. 2, in a region where the superimposed current was high, the inductance values of the composite magnetic cores were superior to that of the ferrite core. In the case where the superimposed current was not applied to the coil, the inductance values of the composite magnetic cores were improved over that of the amorphous metal core.

Figure 3:
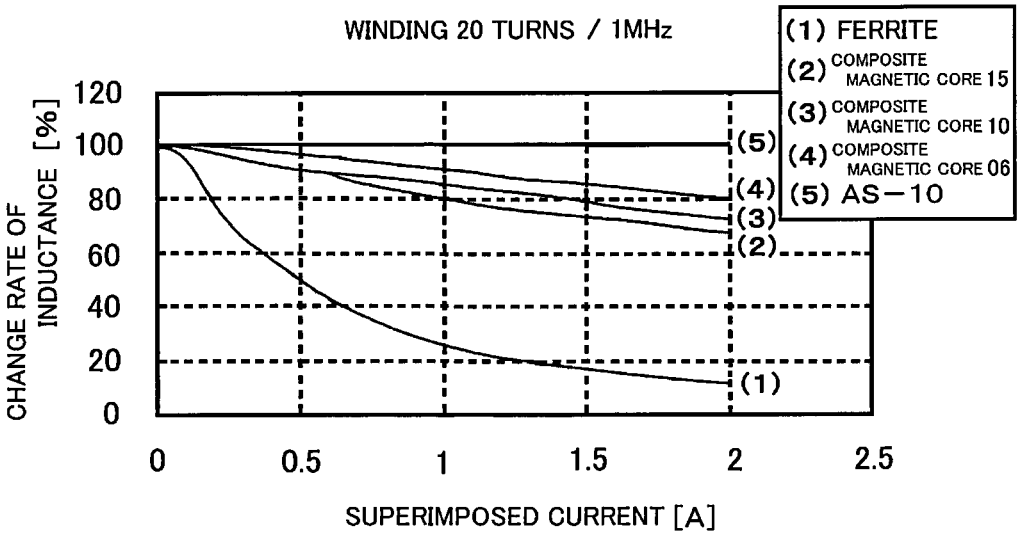
FIG. 3 shows a decrease rate of the inductance value in FIG. 2.

As shown in FIG. 3, it was found that in the case where the value of the superimposed current was increased, the decrease rate (%) of the inductance values of the composite magnetic cores were lower than that of the inductance value of the ferrite core.

It was found from the results that in the region where the predetermined superimposed current is applied to the coil, the inductance values of the composite magnetic cores were improved over that of the ferrite core and that of the amorphous metal core.

The maximum magnetic permeabilities of the composite magnetic cores were slightly lower than that of the ferrite core. But the saturation magnetic flux densities of the composite magnetic cores were approximately two times as high as that of the ferrite core.

The composite magnetic core of the present invention can be used as core components consisting of the soft magnetic material for use in power circuits, filter circuits, switching circuits, and the like of automobiles including two-wheeled vehicles, industrial machineries, and medical devices. For example, the composite magnetic core of the present invention can be used as core components of inductors, transformers, antennas, choke coils, filters, and the like. The composite magnetic core can be also used as magnetic cores of surface mounting parts.

FIGS. 4 through 10 show the configurations of the composite magnetic cores.

Figure 4:
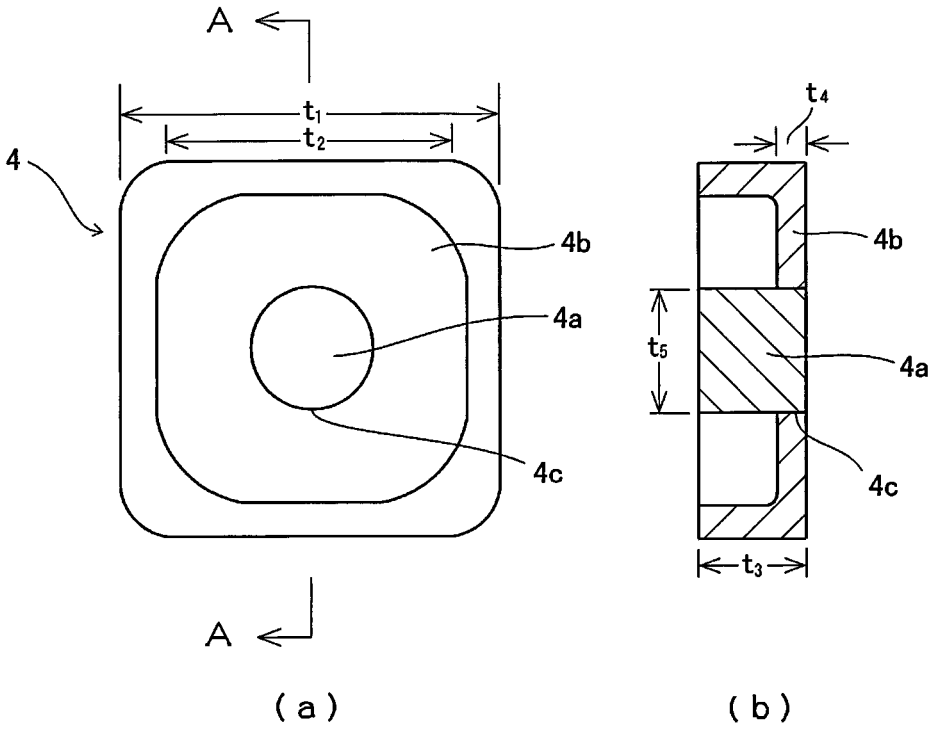
FIG. 4 shows one example of a rectangular core.

FIG. 4 (*a*) shows a plan view of a composite magnetic core 4. FIG. 4 (*b*) shows a sectional view thereof taken along a line A-A. The composite magnetic core 4 is one example of a quadrilateral core square in a planar view.

The composite magnetic core 4 can be produced by press-fitting a compressed magnetic body 4*a* into an injection-molded magnetic body 4*b* at a press-fitting portion 4*c* thereof. Because the compressed magnetic body 4*a* is columnar, it can be easily formed by the compression molding. Because the injection-molded magnetic body 4*b* is sectionally U-shaped and plate-shaped and has a center hole, the injection-molded magnetic body 4*b* can be easily formed by injection molding, even though it is small.

As one example of the dimension of the composite magnetic core 4, $t_1$, $t_2$, $t_3$, $t_4$, and $t_5$ are set to 6 mm, 5 mm, 2 mm, 0.5 mm, and 2 mmϕ respectively.

Figure 5:
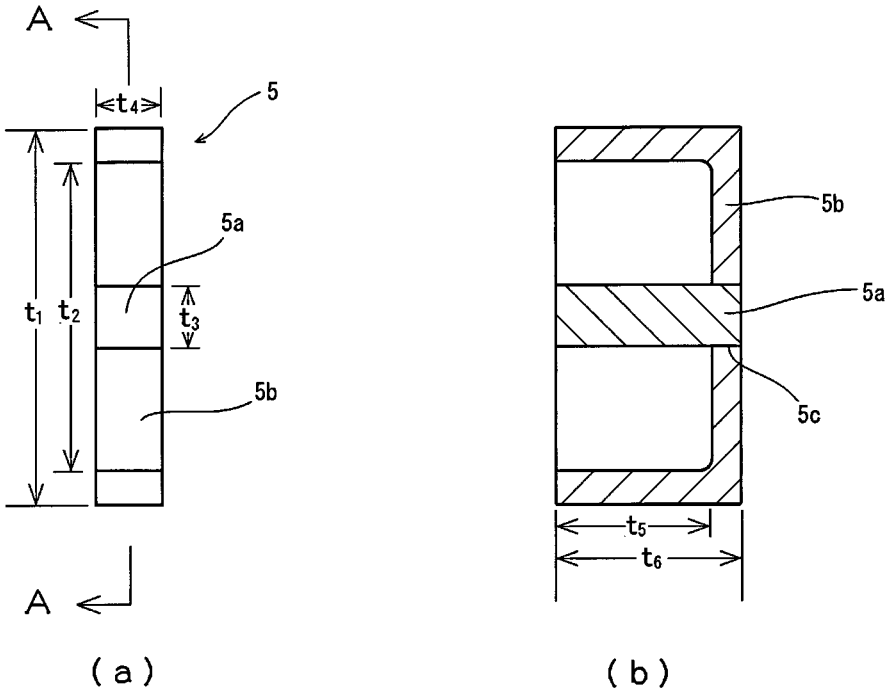
FIG. 5 shows one example of an E-core.

FIG. 5 (*a*) shows a plan view of a composite magnetic core 5. FIG. 5 (*b*) shows a sectional view thereof taken along a line A-A. The composite magnetic core 5 is one example of an E-core.

The composite magnetic core 5 can be produced by bonding a compressed magnetic body 5*a* and two injection-molded magnetic bodies 5*b* to each other at a combining portion 5*c*. The compressed magnetic body 5*a* is columnar, and the injection-molded magnetic bodies 5*b* are sectionally L-shaped. Thus the injection-molded magnetic body 5*b* can be easily formed by injection molding even though it is small.

As one example of the dimension of the composite magnetic core 5, $t_1$, $t_2$, $t_3$, $t_4$, $t_5$ and $t_6$ have 7 mm, 6 mm, 1.5 mm, 1.5 mm, 3 mm, and 4 mm respectively.

Figure 6:
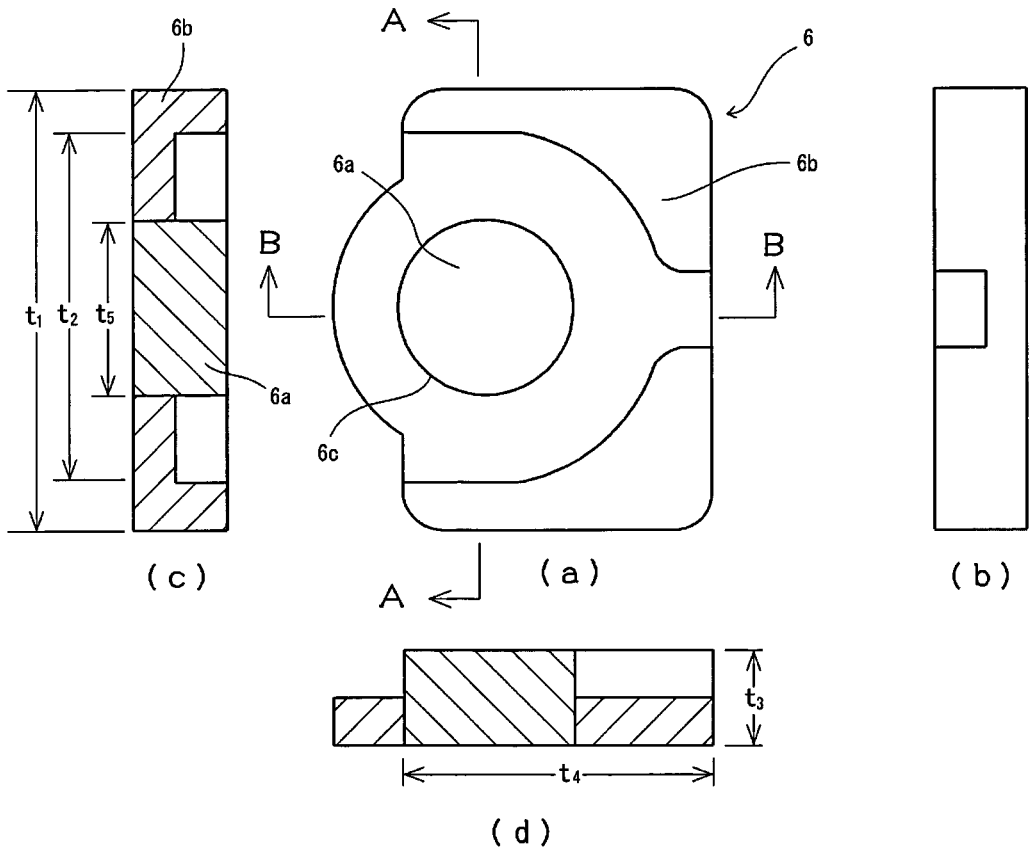
FIG. 6 shows one example of an ER-core.

FIG. 6 (*a*) shows a plan view of a composite magnetic core 6. FIG. 6(*b*) shows a right side view thereof. FIG. 6(*c*) is a sectional view taken along a line A-A. FIG. 6(*d*) is a sectional view taken along a line B-B. The composite magnetic core 6 is one example of an ER-core.

The composite magnetic core 6 can be produced by press-fitting a compressed magnetic body 6*a* into an injection-molded magnetic body 6*b* at a press-fitting portion 6*c* thereof. Because the compressed magnetic body 6*a* is columnar, it can be easily formed by the compression molding. Because the injection-molded magnetic body 6*b* is sectionally U-shaped and plate-shaped and has a center hole, it can be easily formed by injection molding, even though it is small.

As one example of the dimension of the composite magnetic core 6, $t_1$, $t_2$, $t_3$, $t_4$, and $t_5$ are set to 7 mm, 6 mm, 1.5 mm, 5 mm, and 3 mmϕ) respectively.

Figure 7:
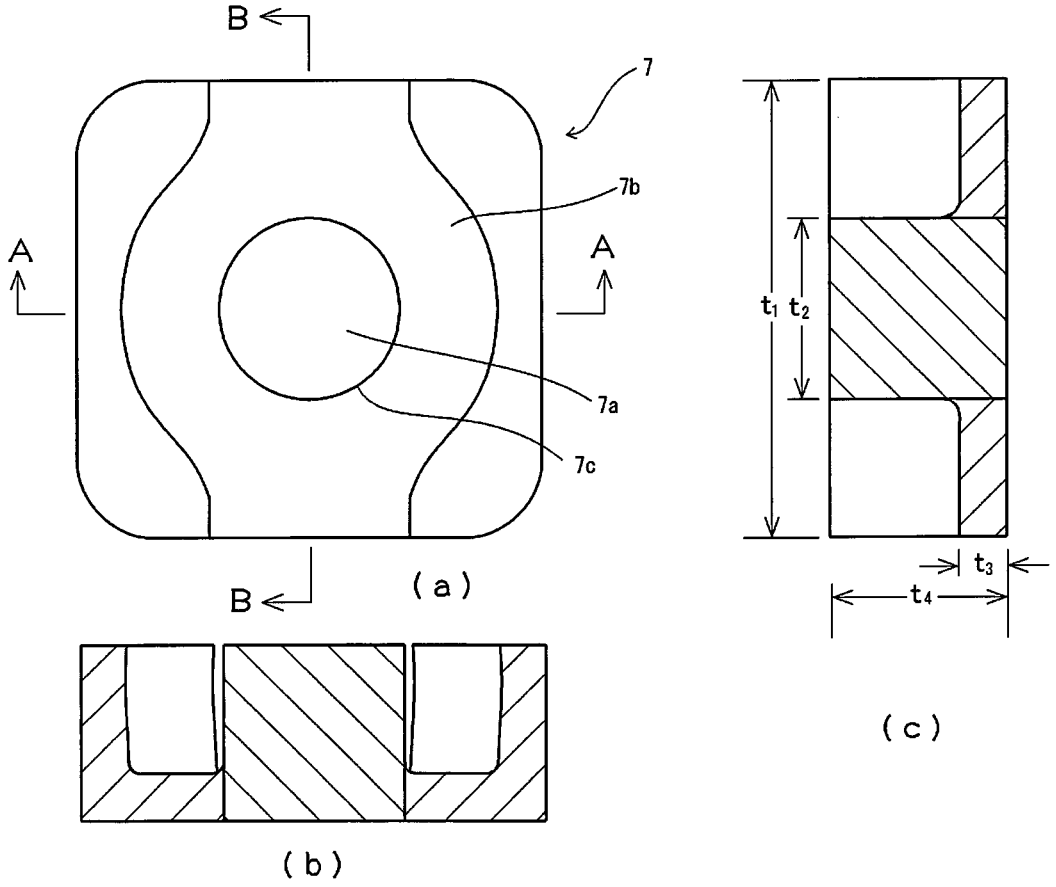
FIG. 7 shows one example of an open type E-core.

FIG. 7 (*a*) shows a plan view of a composite magnetic core 7. FIG. 7(*b*) shows a sectional view taken along a line A-A. FIG. 6(*c*) shows a sectional view taken along a line B-B. The composite magnetic core 7 is one example of an open type E-core.

The composite magnetic core 7 can be produced by press-fitting a compressed magnetic body 7*a* into an injection-molded magnetic body 7*b* at a press-fitting portion 7*c* thereof. Because the compressed magnetic body 7*a* is columnar, it can be easily formed by the compression molding. Because the injection-molded magnetic body 7*b* is sectionally U-shaped and plate-shaped and has a center hole, it can be easily formed by injection molding, even though it is small.

As one example of the dimension of the composite magnetic core 7, $t_1$, $t_2$, $t_3$, and $t_4$ are set to 8 mm, 3 mm, 0.7 mm, and 3 mm respectively.

Figure 8:
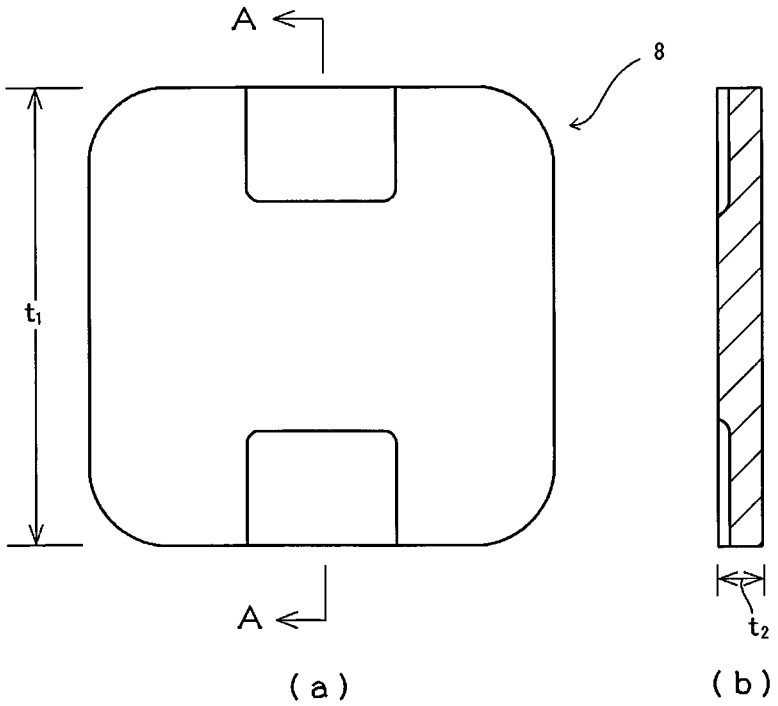
FIG. 8 shows one example of an I-core.

FIG. 8 (*a*) is one example of an I-core to be used in combination with the open type E-core. FIG. 8 (*a*) shows a plan view of the I-core 8. FIG. 8(*b*) shows a sectional view taken along a line A-A.

The I-core 8 can be produced by using a compressed magnetic body or an injection-molded magnetic body. Because the compressed magnetic body and the injection-molded magnetic body are sectionally plate-shaped, the former and the latter can be easily produced by compression-molding a magnetic material and injection-molding a magnetic material respectively, even though they are small.

Figure 9:
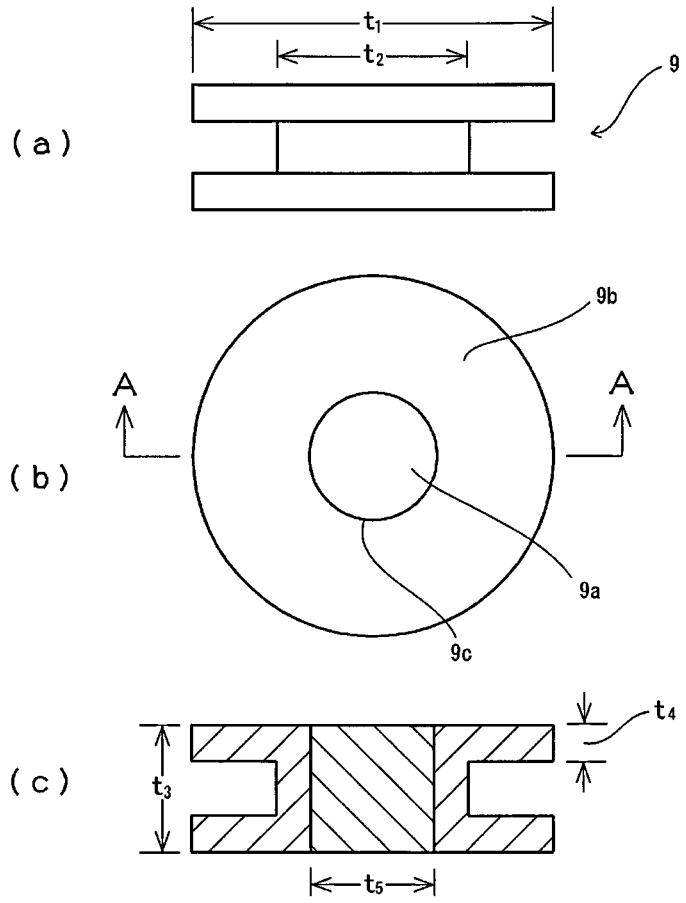
FIG. 9 shows one example of a bobbin core.

As one example of the dimension of the I-core 8, $t_1$ and $t_2$ are set to 8 mm and 0.7 mm respectively FIG. 9 (*a*) shows a front view of a composite magnetic core 9.

FIG. 9(*b*) shows a plan view thereof. FIG. 9 (*c*) shows a sectional view thereof taken along a line A-A. The composite magnetic core 9 is one example of a bobbin core.

The composite magnetic core 9 can be produced by press-fitting a compressed magnetic body 9*a* into an injection-molded magnetic body 9*b* at a press-fitting portion 9*c* thereof. Because the compressed magnetic body 7*a* is columnar, it can be easily formed by the compression molding. Because the injection-molded magnetic body 9*b* has the configuration of a bobbin having a center hole, the injection-molded magnetic body 9*b* can be easily formed by injection molding, even though it is small.

As one example of the dimension of the composite magnetic core 9, $t_1$, $t_2$, $t_3$, $t_4$, and $t_5$ are set to 3 mmϕ, 1.5 mmϕ, 1 mm, 0.25 mm, and 1 mmϕ respectively.

Figure 10:
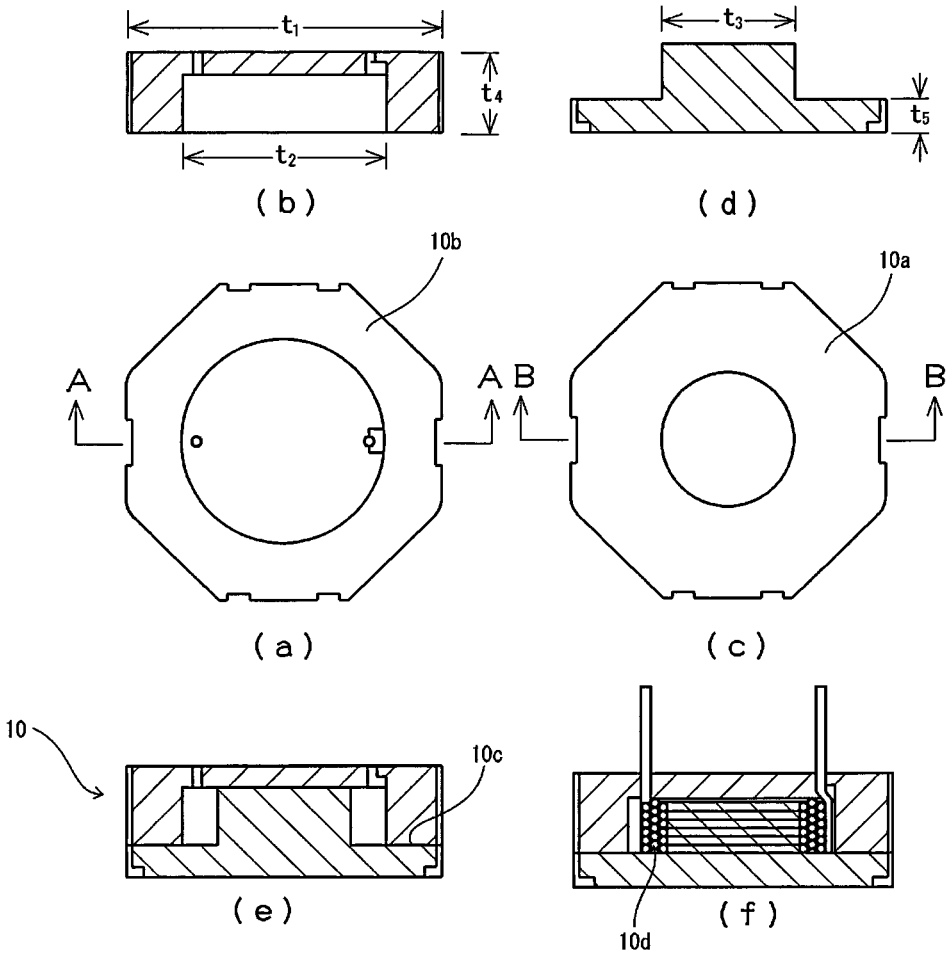
FIG. 10 shows one example of an octagonal core.

FIG. 10(*a*) shows a plan view of an upper member constituting a composite magnetic core 10. FIG. 10(*b*) shows a sectional view taken along a line A-A. FIG. 10(*c*) shows a plan view of a lower member constituting the composite magnetic core 10. FIG. 10 (*d*) shows a sectional view thereof taken along a line B-B. FIG. 10(*e*) shows a sectional view thereof in which the upper member and the lower member are combined with each other. FIG. 10(*f*) shows a sectional view thereof in which an inductor is formed by winding a coil around a compressed magnetic body. The composite magnetic core 10 is one example of an octagonal core.

The upper member and the lower member both constituting the composite magnetic core 10 are formed as an injection-molded magnetic body 10*b* and a compressed magnetic body 10*a* respectively. The injection-molded magnetic body 10*b* and the compressed magnetic body 10*a* around which the coil has been wound are bonded to each other at a combining portion 10*c* to form an inductor. Because the compressed magnetic body 10*a* is columnar and has a convex portion in its cross section and thus has a simple configuration, the compressed magnetic body 10*a* can be easily formed by the compression molding. Because the injection-molded magnetic body 10*b* is sectionally U-shaped and plate-shaped, the injection-molded magnetic body 10*b* can be easily formed by the injection molding, even though it is small.

As one example of the dimension of the composite magnetic core 10, $t_1$, $t_2$, $t_3$, $t_4$, and $t_5$ are set to 7 mm, 5 mmϕ, 3 mmϕ, 2 mm, and 0.7 mm respectively.

As described above, the composite magnetic core of the present invention can be used as an ultra-small composite magnetic core having a thickness not less than 1 mm nor more than 5 mm and a maximum diameter not more than 15 mm and preferably 3 mm to 10 mm square millimeters or 3 mm to 10 mmϕ in a planar view.

Regarding the dimension of the compressed magnetic body constituting the composite magnetic core, it is necessary that the compressed magnetic body has a thickness of not less than 0.8 mm to form it by the compression molding. The compressed magnetic body is required to have a pressurizing area of one square millimeter or 1 mmϕ.

In the case where an attempt is made to compose the composite magnetic cores shown in FIGS. 4 through 10 of an injection-molded body containing a composition consisting of the ferrite powders, the amorphous powders, and the thermoplastic resin, the magnetic core consisting of the injection-molded body cracks or the like. Thus it is difficult to form the composite magnetic core by the injection molding. In consideration of this problem, in the present invention, by combining the injection-molded magnetic body produced separately from the compressed magnetic body with each other, an ultra-small composite magnetic core is obtained.

The magnetic element of the present invention is composed of the composite magnetic core of the present invention and a winding wound around the circumference thereof to form a coil having the function of an inductor. The magnetic element is incorporated in circuits of electronic devices.

As the winding, the copper enamel wire can be used. It is possible to use a urethane wire (UEW), a formal wire (PVF), polyester wire (PEW), a polyester imide wire (EIW), a polyamideimide wire (AIW), a polyimide wire (PIW), a double coated wire consisting of these wires combined with one another, a self-welding wire, and a litz wire. It is possible to use the copper enamel wire round or rectangular in the sectional configuration thereof.

As coil-winding methods, it is possible to adopt a helical winding method or a toroidal winding method. In winding the coil around the ultra-small composite magnetic core of the present invention, a columnar coil or a plate-shaped coil is more favorable than a donut-shaped core to be used as the core for a toroidal core.

As one example of the magnetic element of the present invention, a compressed magnetic body having a dimension of 2.6 mm×1.6 mm×1.0 mm was press-fitted into an injection-molded magnetic body having a dimension of 4.6 mm×3.6 mm×1.0 mm to form a composite magnetic core. The composite magnetic core was wound with 26 turns of a winding having a diameter of 0.11 mmϕ to form an inductor. The inductance value (electric current: 2 A, frequency: 1 MHz) of the inductor was not less than 10 μH.

A square pillar-shaped ferrite compressed magnetic body which has a dimension of 4.6 mm×3.6 mm×1.0 mm was wound with 26 turns of the winding having the diameter of 0.11 mmϕ) to form an inductor. The inductance value (electric current: 1.5 A, frequency: 1 MHz) of the inductor was 4.7 pH.

The magnetic element of the present invention can be preferably used as chip inductors for use in high frequency circuits of laptop computers and portable telephones.

INDUSTRIAL APPLICABILITY

Because the composite magnetic core of the present invention can be formed compactly, it can be utilized for electronic equipment which will be decreased in the size and weight thereof in the future.

EXPLANATION OF REFERENCE NUMERALS AND SYMBOLS

1: composite magnetic core
2: compressed magnetic body
3: injection-molded magnetic body
4 through 10: composite magnetic core

The invention claimed is:

1. A composite magnetic core comprising a combined body of a compressed magnetic body, obtained by compression-molding magnetic powders, which is combined with an injection-molded magnetic body obtained by mixing a binding resin with magnetic powders having surfaces thereof electrically insulated and by injection-molding a mixture of said magnetic powders and said binding resin, wherein said injection-molded magnetic body constitutes a housing, and said compressed magnetic body is disposed inside said housing, wherein said compressed magnetic body is obtained by compression-molding (i) said magnetic powders or (ii) powders, consisting of said magnetic powders, which have been mixed with thermosetting resin to form a compressed powder compact and firing said compressed powder compact, wherein said magnetic powders of said magnetic body are ferrite powders, wherein a mixing ratio of said magnetic powders of said compressed magnetic body is set to 96 to 100 percent by mass based on a total of an amount of said magnetic powders of said compressed magnetic body and that of said thermosetting resin, wherein said magnetic powders of said injection-molded magnetic body are amorphous metal powders, and said binding resin is a thermoplastic resin wherein a mixing ratio of said magnetic powders of said injection-molded magnetic body is set to 80 to 95 percent by mass based on a total amount of said magnetic powders of said injection molded magnetic body and that of said binding resin, wherein said combined body is formed by press-fitting said compressed magnetic body into said housing or bonding said compressed magnetic body thereto, and wherein said compressed magnetic body is disposed inside a space of said housing with said compressed magnetic body in close contact with said injection-molded magnetic body.

2. A composite magnetic core according to claim 1, wherein when a value of superimposed direct current flowing through a coil wound around a circumference of said combined body is increased, a decrease rate of an inductance of said composite magnetic core is lower than that of an inductance of a ferrite magnetic core.

3. A magnetic element which includes a magnetic core and a coil wound around a circumference of said magnetic core and is incorporated in circuits of electronic devices, wherein said magnetic core is a composite magnetic core as claimed in claim 1.

4. A magnetic element according to claim 3, wherein a combined body of said composite magnetic core is formed by press-fitting said compressed magnetic body into said housing or bonding said compressed magnetic body thereto.

* * * * *